US006554588B1

(12) United States Patent
DiBenedetto

(10) Patent No.: US 6,554,588 B1
(45) Date of Patent: Apr. 29, 2003

(54) COMPOSITE PISTON FOR A VIBRATION PUMP

(75) Inventor: Calogero DiBenedetto, S. Martino Sicc. (IT)

(73) Assignee: Ulka SRL, Pavia (IT)

( * ) Notice: Subject to any disclaimer, the term of this patent is extended or adjusted under 35 U.S.C. 154(b) by 0 days.

(21) Appl. No.: 09/937,586

(22) PCT Filed: Mar. 13, 2000

(86) PCT No.: PCT/EP00/02201

§ 371 (c)(1),
(2), (4) Date: Sep. 27, 2001

(87) PCT Pub. No.: WO00/61946

PCT Pub. Date: Oct. 19, 2000

(30) Foreign Application Priority Data

Apr. 9, 1999 (IT) ..... MI99U0201

(51) Int. Cl.[7] ..... F04B 35/04

(52) U.S. Cl. ..... 417/417; 417/416; 417/418; 92/222

(58) Field of Search ..... 417/412, 416, 417/417, 418; 92/222, 172–259

(56) References Cited

U.S. PATENT DOCUMENTS

| | | | | |
|---|---|---|---|---|
| 4,375,941 A | * | 3/1983 | Child | 417/53 |
| 4,683,810 A | | 8/1987 | Afimiwala | |
| 5,826,686 A | * | 10/1998 | Rike | 188/264 G |

FOREIGN PATENT DOCUMENTS

| | | |
|---|---|---|
| DE | 295 18 782 U1 | 3/1997 |
| EP | 0 288 216 A1 | 10/1988 |
| EP | 0 499 367 A2 | 8/1992 |
| FR | 2 332 440 | 6/1977 |
| WO | 91/19903 | 12/1991 |

* cited by examiner

*Primary Examiner*—Charles G. Freay
*Assistant Examiner*—John F Belena
(74) *Attorney, Agent, or Firm*—Katten Muchin Zavis Rosenman

(57) ABSTRACT

A composite piston (30) for a vibration pump comprises a core (32), activating a piston, and a piston (34) made of plastic and obtained by means of molding on an insert formed by the core (32). The composite piston (30) thus obtained achieves objects of high precision at a low cost which cannot be achieved with traditional simple pistons made entirely of ferromagnetic metal.

16 Claims, 3 Drawing Sheets

COMPOSITE PISTON FOR A VIBRATION PUMP

The present invention relates to a composite piston for vibration pumps comprising a driving part made of ferromagnetic material and a pumping part made of plastic and obtained by means of moulding on a metal insert forming the driving part thereof.

Vibration pumps are fundamental components which are very widespread in many applications and in different sectors. In particular these pumps are widely used for feeding boilers of electric household appliances and especially machines for preparing hot drinks by means of infusion with powders containing the ingredients necessary for preparation thereof, such as machines for the preparation of espresso coffee and similar drinks. The growing use of these vibration pumps is accompanied by the need total reliability to be obtained at an increasingly lower cost.

Initial efforts to limit the price of these pumps were directed towards the choice of materials forming the structure of the pumping body and the electromagnetic apparatus and optimisation of their form and size so as to obtain increasingly reliable and economical parts. By way a secondary effort, research aimed at obtaining a greater degree of automation of the production plants also helped reduce the production costs.

At this point, in order to reduce further the production costs, it was necessary to modify certain components which normally are never taken into consideration because they are "apparently" already simple, but which nevertheless may still be the source of defects in the end product, albeit to a very small extent.

One of these components is the piston pump, which hitherto has been made entirely of metallic material by means of mechanical machining.

Hitherto, for the sake of simplicity, it was considered to be particularly economical and logical to construct the piston of a vibration pump as a single metal part.

However, when analysing the methods used for manufacture of an entirely metal piston and the requirements which this piston must satisfy, several facts which apparently had not come to light now emerged:

1. In a traditional vibration pump the piston is immersed in the liquid to be pumped, hence the need for a high magnetic efficiency and high corrosion resistance. Unfortunately these two characteristics are directly opposed since metallic materials, which have an excellent corrosion resistance, are devoid of ferromagnetic properties, while, on the other hand, materials which have excellent ferromagnetic properties and hence a high magnetic efficiency, have a low corrosion resistance. In short, it has been necessary to adopt compromise solutions which, however, are heavily biased either towards a high corrosion resistance, with poor ferromagnetic properties, or towards good ferromagnetic properties, with a low corrosion resistance. Recent research has indeed produced particular materials which provide an excellent balance, ensuring a high corrosion resistance and good ferromagnetic properties, even though this material has been unable to eliminate the occurrence of problems which, in this case, are of a mechanical nature.
2. As an alternative to the mechanical piston immersed in the pumped liquid, it was thought to provide pumps, in which the electromagnetic portion is separate from the pumping portion. However, such a solution implies the need to construct coils containing a large quantity of copper wire, the cost of which is extremely high or, alternatively, to construct pumps with an inferior performance, in particular at high working pressures, which may not always be satisfactory.
3. The traditional vibration pump comprises a piston which must perform various functions:
   - it has to convert the force, due to the magnetic field of the coil, into movement;
   - it must provide a hydraulic seal, during the stroke, with the cylinder of the pump body;
   - it must ensure the dynamic seal of the intake valve; and
   - it must allow the outflow of liquid into the chamber preceding the pressure chamber.

In order to perform correctly all these functions, the piston must be manufactured to an industrially acceptable standard with very small tolerances in terms of finish, size and geometrical shape. The dimensional tolerances are therefore extremely important and negatively influence the production cost, in the sense that large tolerances result in a higher number of reject components which are not up to standard and smaller tolerances are possible only at the cost of further machining operations which increase the production costs. However, the parts thus manufactured are unable to guarantee fully the overall quality because the critical points are obtained by means of removal of shavings on automatic machine tools which are required to produce millions of parts per year. In this case, any machining imprecision or the presence of burrs or imperfect finishes make it difficult to guarantee 100% quality which can be obtained only by means of costly and rigorous verification procedures during the pre-assembly stage.

In the prior art EP-A-0 288 216 discloses and claims an electrical fluid pump using a wide part, consisting of a ferromagnetic piece working as portion of the pump moved by the magnetic field of a solenoid coil, and a restricted part, consisting of nonmagnetic material (such as plastic or a non magnetic metal), working as a pump piston and inserted into a central bore of the wide part and there fastened by crimping-in of a lip provided at an end of the wide part.

One object of the present invention is that of producing these pistons in a direct and low-cost manner using a simple direct machining process which excludes finishing operations for parts which have already been machined The above mentioned objects are achieved by a piston according to the present invention comprising a part which is made of ferromagnetic metallic material, limited in extension to the piston zone intended to perform the magnetic driving function, and a part which is made of non-metallic and non-ferromagnetic material and performs the pumping function of the same piston, the metal part performing the magnetic moving function being made of stainless steel possessing good ferromagnetic properties, characterized in that: the part performing the pumping function is made of a plastic material moulded on the metal part and inserted with a part thereof, consisting of a cylindrical blank, in an axial bore.

Apparently in the prior art the use of materials other than metal was discouraged because the mechanical action of a radial seal at high working pressures caused significant wear also in the case of stainless steel, so that the logical doubt arose that any plastic material would have been subject to even greater wear and, in addition, the mechanical assembly of the metal magnetic driving part with the plastic part, as disclosed in EP-A-0 288 216, apparently required costly systems to correct any clearance and ensure the precision and necessary quality control.

However, it was discovered that, if the temperature of the water to be pumped were to remain close to room temperature (15 to 25° C.), with maximum temperatures of the piston remaining between 50 and 60° C., there would be no particular difficulty in using thermoplastic materials, possibly containing a reinforcing filler, such as, for example polyamides (nylon) reinforced with glass fibres, ground quartz, fumed silica, diatomaceous earth or the like, the piston being obtained by means of moulding of the thermoplastic material onto a stainless-steel insert of the ferromagnetic type. A practical example of a suitable low-cost and commercially freely available thermoplastic material could be nylon 6.6 containing 30% glass fibres.

Obviously, owing to a certain tendency of nylon 6.6 to absorb—albeit in small quantities—water, this would limit the life of the piston, although to time periods of a duration such as to render obsolete the device in which a vibration pump containing said piston was installed.

Moreover, if there was an absolute need for total reliability of the pump to be obtained using thermoplastic materials which are not subject to the drawbacks of the abovementioned nylon 6.6, it is possible to find on the market thermoplastic materials, such as oxy-1,4-phenylene-oxy-1,4-phenylene-carbonyl-1,4-phenylene, produced and marketed by Vitrex Plc in Thorton Cleveleys, Lancashire, United Kingdom, under the tradename Peek™, which material is resistance to temperatures much higher than those which can be withstood by nylon 6,6 and has substantially zero water absorption.

The features of the composite piston according to the present invention are illustrated below:

The piston, as already mentioned, is formed by a metal part and by a plastic part.

The metal part is a simple, low-cost, hollow cylinder which is essentially devoid of defects which may adversely affect operation of the pump. Its geometric form and its size are suitable for providing the magnetic driving force. The internal part is shaped so as to form a portion ensuring a secure mechanical fastening to the thermoplastic material which is subsequently moulded on top thereof. In particular:

- as in the traditional version, in this version also, the tolerances of the external diameter are ensured by the drawing of steel bars which therefore do not have to be machined using a machine-tool of any kind;
- the only dimension which must remain within the tolerance values is the length of the part so as to ensure the hermetic closure of the mould used for injection of the thermoplastic material, this dimension, however, being easy to obtain and to control;
- the degree of finish of the internal part of the hole is no longer of any importance because the latter may be lined with thermoplastic resin; on the contrary an inferior finish may favour fixing of the resin to the said wall. In traditional pistons which are made entirely of stainless steel, in addition to the internal hole, the transverse hole for the outflow of liquid into the chamber preceding the pressure chamber requires an optimum burr-free finish because:
  - an inadequate finish favours surface oxidation and dispersion of the oxides in the pumped liquid (it should be remembered that iron oxides, even though posing absolutely no danger for health, are aesthetically unpleasing owing to their somewhat dark and intense colour and may provide the beverages with an unpleasant after-taste);
  - possible machining burrs could become detached during operation, coming into contact with the sealing valves and adversely affecting operation thereof.

The plastic part forms the functional structure of the piston, replacing the more critical and delicate parts thereof, which, in the case of an entirely metallic piston, being obtained by means of mechanical machining operations, may have the following defects:

a) In the intake valve seat:
   geometrical defects, such as ovalisation or eccentricity;
   insufficient degree of finish;
   burrs;
   metallic machining dust residue.

These defects result in the drawbacks of an imperfect seal, irregular operation and inadequate performance.

During operation, there may also be the risk of imperfect seating of the valve caused by calcareous deposits or detergents which are used when the pump has been left half-empty and inactive for long periods, resulting in sticking of the valve and malfunctioning of the pump.

All of the abovementioned defects are eliminated by a plastic valve seat.

b) In the diameter of the pressure member, defects in the finish and size and tolerance of the diameter result in an important seal, irregular operation and inferior performance.

c) In the chamber preceding the pressure chamber for outflow of the liquid, defects consisting of burrs between the transverse hole and the longitudinal hole and an inadequate finish result in the possibility of the said burrs becoming detached and wedged or trapped inside the valve seat which therefore loses its sealing capacity, while an inferior finish results in potential exposure to oxidation.

All the abovementioned defects are eliminated by a portion made of plastic.

It should be pointed out that, even if oxy-1,4-phenylene-oxy-1,4-phenylene-carbonyl-1,4-phenylene (Peek™) were to be used as the plastic, which material has a cost, for the same weight, about 38 times greater than that of stainless steel, a considerable saving equal to between 40 and 60% of the cost of a piston which is made entirely of stainless steel is achieved since, if a traditional piston were to be made entirely of stainless steel, considering that it is necessary to have initially a semi-finished steel product with a length equal to that of the entire piston (i.e. magnetic driving part plus compression part), 75 g of stainless steel and high machining costs would be necessary in order to obtain the machined part using a multiple-spindle machine tool. On the other hand, if a composite piston according to the present invention were to be made, not even half the stainless steel semi-finished product in weight would be used, a negligible machined fraction of the steel used would be necessary and the rest of the plastic piston would be obtained by means of a simple moulding operation without further machining since the plastic part, once moulded, is completely finished. At least, the cost of a composite piston according to the present invention, compared to a traditional piston, would be of the order of between 40 and 60% thereof.

If we consider the abovementioned positive aspects, the advantage of providing piston for vibration pumps with a magnetic driving part made of stainless steel and a compression part made of plastic is obvious.

The features of the present invention will be summarised in particular in the claims forming the conclusive part of the present invention. Other features and advantages will emerge, however, from the detailed description of an embodiment of the invention, with reference to the accompanying drawings, in which:

Figure 1:
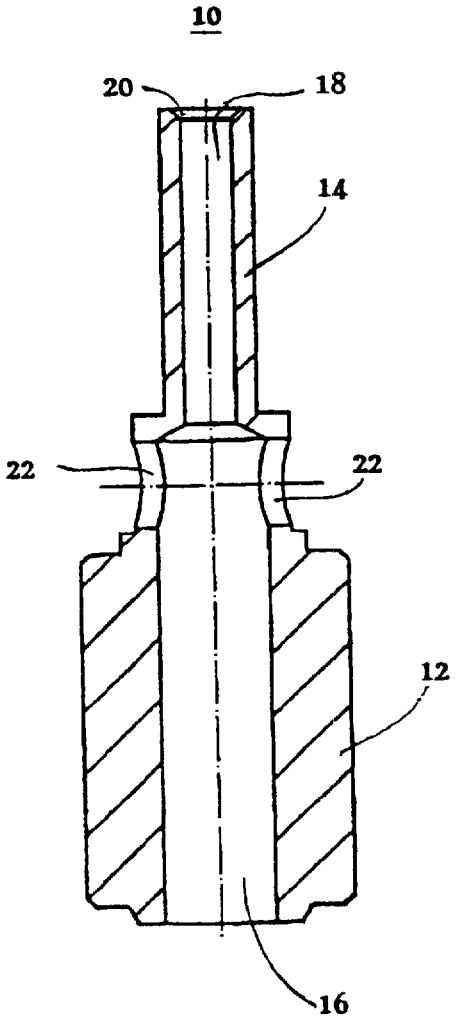
FIG. 1 (PRIOR ART)
FIG. 1 is a cross-sectional side view of a traditional vibration pump piston made entirely of metallic material according to the prior art.

If we consider FIG. 1 which depicts the traditional piston of the prior art, which is made entirely of stainless steel, it can be seen that a traditional piston 10 comprises a wide magnetic driving part 12 and a narrow collar 14 which acts as the actual pump piston. The magnetic driving part 12 has a through-hole 16 having the function of allowing a liquid to rise up inside the piston when it is sucked inside the solenoid for actuating the pump. The narrow neck 14 acts a compression member each time the piston is released by the magnetic field produced by the vibration pump solenoid. For this purpose, the neck 14 has an opening 18 finished at the top with a valve seat 20. The top of the aperture 16 of the magnetic moving part 12 has, passing through it, a transverse hole 22 for allowing pressure compensation inside a chamber for sliding of the said piston. This is the traditional piston of the prior art with the drawbacks described above.

Figure 2:
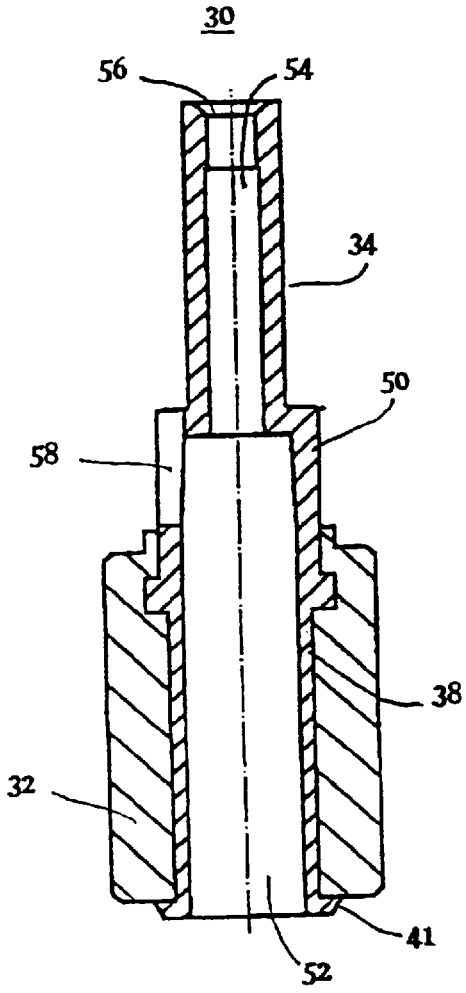
FIG. 2 is a cross-sectional side view of a first embodiment of a composite piston for a vibration pump, according to the present invention.
Figure 3:
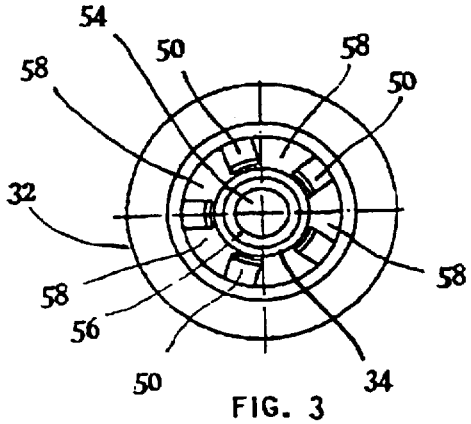
FIG. 3 is a top plan view of a composite piston according to the present invention depicted in FIG. 2.
Figure 4:
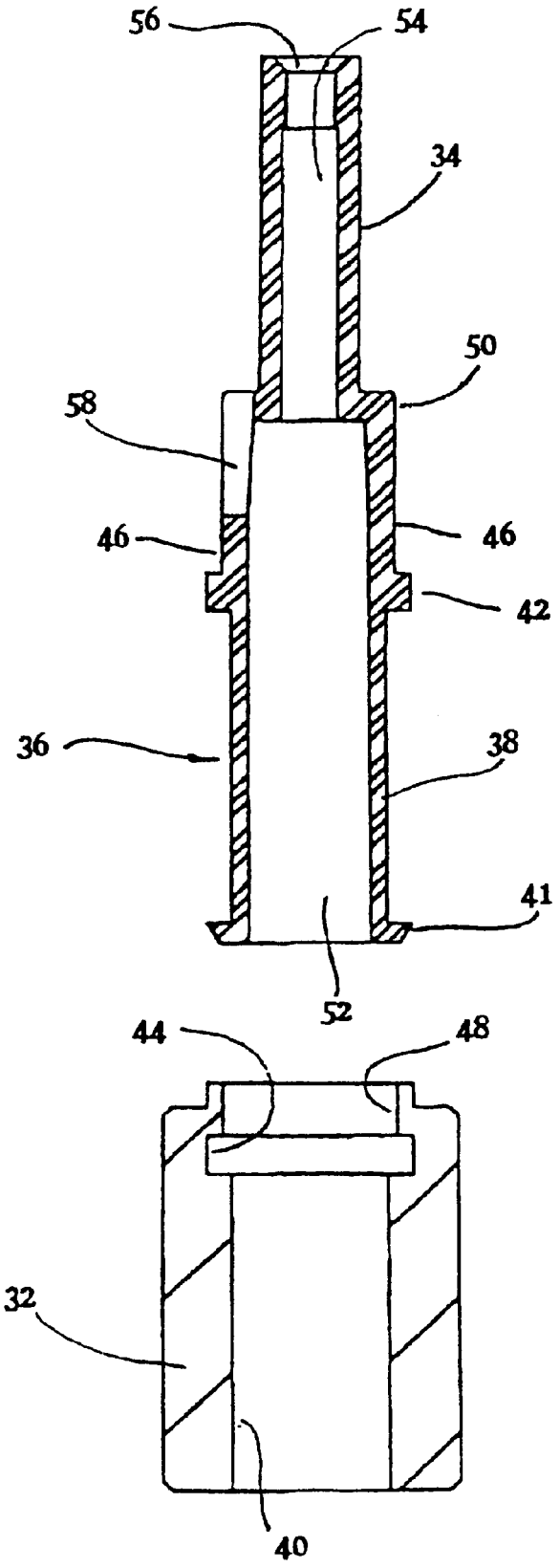
FIG. 4 is an exploded sectional view of the composite piston according to the present invention, which depicts in particular the metal component and the plastic component of the said piston.

Let us now consider FIGS. 2 to 4 which show a cross-sectional and end view of a first embodiment of a piston according to the present invention.

According to FIGS. 2 to 4, a piston 30 according to the present invention consists of a core 32 of corrosion-resistant ferromagnetic material, such as ferromagnetic stainless steel, on top of which there is mounted a piston 34 made of thermoplastic material which can be injection-moulded and which is formed inside the core 32 as a cylindrical blank 36 of moulded thermoplastic material (see in particular FIG. 4).

Still considering FIGS. 2 to 4, it can be seen that the blank 38 of thermoplastic material is formed by a bottom part 36 which extends inside an axial bore 40 passing through the core 32 and is provided with an upset bottom rim 41 and a projecting collar 42 which is housed inside a circumferential cavity 44 surrounding the axial hole 40. Beyond the collar 42, the blank 36 continues as a cylindrical portion 46 which occupies a through-hole 48 aligned axially with the hole 40 of the said core 32. The cylindrical portion 46 continues, in turn, with one or more shoulders 50 which connect the bottom part 38 to the piston 34.

The bottom part 38 and the piston 34 respectively have, passing through them, axially aligned cylindrical holes 52 and 54 which are connected together, the hole 54 terminating in a valve seat 56. The shoulders 50 alternate with openings 58 so as to ensure the same function as the transverse hole 22 of the traditional piston according to FIG. 1.

It is obvious, from FIGS. 3 and 4, that the blank 36 of thermoplastic material, being moulded within the core 32, will never be able to move or in any case become detached from the said core, so that the composite piston 30 will always act as a single piece.

Figure 5:
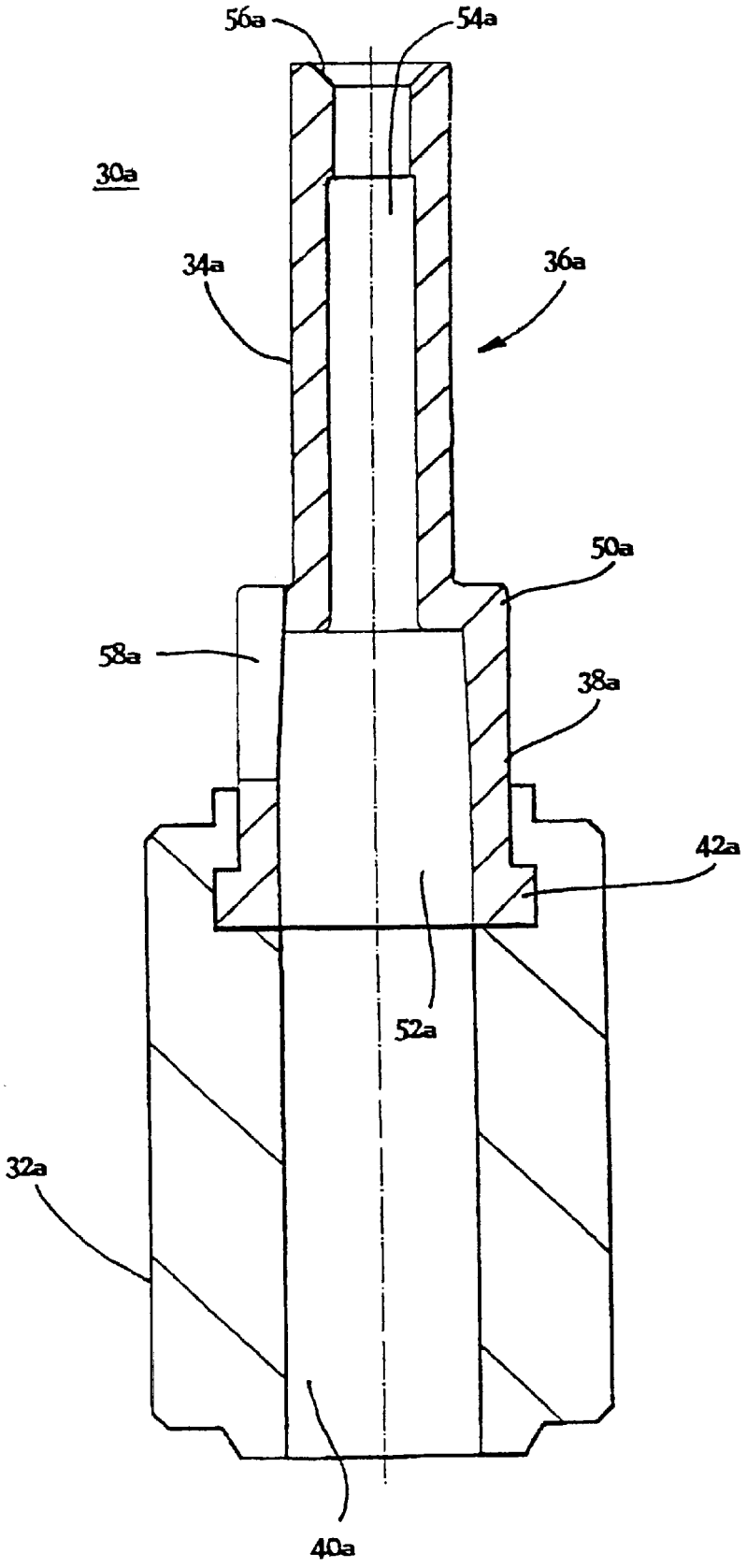
FIG. 5 is a cross-sectional side view of a second simplified embodiment of a composite piston for a vibration pump according to the present invention.

Let us now consider FIG. 5 which shows a second—decidedly simpler—embodiment of a piston 30*a* according to the present invention. According to this embodiment, the piston 30*a* consists of a core 32*a* of stainless and ferromagnetic material which has, mounted on top of it, a piston 34*a* which is made of thermoplastic material and can be injection-moulded and which is formed inside the core 32*a* as a blank 36*a* of thermoplastic material.

The blank 36*a* is formed by a bottom part 38*a* extending inside the top part of an axial hole 40*a* passing through the core 32*a* and provided with a projecting collar 42*a* which engages inside a corresponding recessed cavity present on the walls of the axial hole 40*a*. In addition to the collar 42*a,* the bottom part 38*a* terminates in one or more shoulders 50*a* which connect the bottom part 38*a* to the piston 34*a*.

The bottom part 38*a* and the piston 34*a* respectively have, passing through them, axially aligned cylindrical holes 52*a* and 54*a,* which are connected together, the hole 54*a* terminating in a valve seat 56*a*. The shoulders 50*a* alternate with openings 58*a* so as to ensure the same function as the transverse hole 22 of the traditional piston according to FIG. 1.

It is obvious from FIG. 5 that the blank 36*a* of thermoplastic material, being moulded within the core 32*a* and kept fixed by the projecting collar 42*a* and precisely aligned with the said core 32*a,* will never be able to move or in any case become detached from the said core 32*a,* since the core 32*a* and piston 34*a* move in precisely aligned cylindrical cavities, so that the composite piston 30*a* will always act as a single piece.

The above description illustrates two embodiments of a composite piston for a vibration pump according to the present invention, which are not to be regarded as limiting in any way. Indeed, logical and equivalent variations may occur to persons skilled in this particular art and are to be regarded as here covered, as defined by the accompanying claims.

What is claimed is:

1. Composite piston (30, 30*a*) for a vibration pump with an electromagnetic drive comprising:

a core (32, 32*a*) which is made of ferromagnetic metallic material limited in extension to the piston zone intended to perform the magnetic driving function, a piston (34, 34*a*) which is made of non-metallic and non-ferromagnetic material and performs the pumping function, the metal core (32, 32*a*) performing the magnetic moving function being made of stainless steel possessing ferromagnetic properties, characterized in that:

the piston (34, 34*a*) performing the pumping function is made of a plastic material moulded on the metal core (32, 32*a*) and inserted with a part thereof, consisting of a cylindrical blank (36, 36*a*) in an axial bore (40, 40*a*) provided with an upset bottom rim (41) which rests against a bottom side of the metal core (32) and a projecting collar (42) which is housed inside a circumferential cavity (44) of the said metal core (32).

2. Composite piston for a vibration pump according to claim 1, characterized in that the cylindrical blank (36) is made using a thermoplastic resin.

3. Composite piston for a vibration pump according to claim 2, characterized in that the cylindrical blank (36) is made using a polyamide resin.

4. Composite piston for a vibration pump according to claim 3, characterized in that the polyamide resin is Nylon 6.6.

5. Composite piston for a vibration pump according to claim 4, characterized in that the Nylon 6.6 contains a reinforcing filler.

6. Composite piston for a vibration pump according to claim 5, characterized in that the reinforcing filler consists of glass fibre.

7. Composite piston for a vibration pump according to claim 5, characterized in that the reinforcing filler consists of ground quartz.

8. Composite piston for a vibration pump according to claim 5, characterized in that the reinforcing filler consists of fumed silica.

9. Composite piston for a vibration pump according to claim 5, characterized in that the reinforcing filler consists of diatomaceous earth.

10. Composite piston for a vibration pump according to claim 5, characterized in that the reinforcing filler consists of 30% glass fibres.

11. Composite piston for a vibration pump according to claim 2, characterized in that the cylindrical blank (36) made of plastic is made using an oxy-1,4-phenylene-oxy-1,4-phenylene-carbonyl-1,4-phenylene resin.

12. Composite piston for a vibration pump according to claim 1, characterized in that the metal core (32) consists of a cylindrical piece having, passing through it, a first axial bore (40) provided with a circumferential cavity (44) and continuing with a second through-hole (48).

13. Composite piston for a vibration pump according to claim 12, characterized in that the cylindrical blank (36) made of plastic is formed by a bottom part (38) which is moulded inside the axial bore (40) of the metal core (32) and comprises at least one shoulder (50) which connects the bottom part (38) to the piston (34).

14. Composite piston for a vibration pump according to claim 13, characterized in that the cylindrical blank (36) made of plastic has a bottom part (38) with, passing through it, an axial bore (52) which opens out into side openings (58) alternating with the shoulders (50) and the piston (34) has, passing through it, an axial bore (54) aligned with the axial-bore (52) in the bottom part (38) and terminating in a valve seat (56).

15. Composite piston for a vibration pump according to claim 1 characterized in that the cylindrical blank **(36*a*) is made of plastic is formed by a bottom part (38*a*) which is moulded inside the axial bore (40*a*) of the metal core (32*a*) and is provided with a projecting collar (42*a*) which is housed in a corresponding circumferential cavity in the said metal core (32*a*) and with at least one shoulder (50*a*) which connects the bottom part (38*a*) to the piston (34*a*)**.

16. Composite piston for a vibration pump according to claim 15, characterized in that the cylindrical blank **(36*a*) made of plastic has a bottom part (38*a*) with, passing through it, an axial bore (52*a*) which opens out into side openings (58*a*) alternating with the shoulders (50*a*) and the piston (34*a*) has, passing through it, an axial bore (54*a*) aligned with the axial bore (52*a*) of the bottom part (38*a*) and terminating in a valve seat (56*a*)**.

* * * * *